US008727864B2

(12) United States Patent
Bucknall et al.

(10) Patent No.: US 8,727,864 B2
(45) Date of Patent: May 20, 2014

(54) GAMING MACHINE WITH TRANSPARENT SYMBOL CARRIERS

(75) Inventors: Helen Bucknall, Sydney (AU); Amanda Emmett, Sydney (AU); Craig Woodcroft, London (GB); Nigel Crompton, Sydney (AU)

(73) Assignee: Aristocrat Technologies Austrualia Pty. Ltd. (AU)

( * ) Notice: Subject to any disclaimer, the term of this patent is extended or adjusted under 35 U.S.C. 154(b) by 444 days.

(21) Appl. No.: 11/623,399

(22) Filed: Jan. 16, 2007

(65) Prior Publication Data

US 2007/0111788 A1 May 17, 2007

Related U.S. Application Data

(63) Continuation of application No. 10/072,401, filed on Feb. 6, 2002, now abandoned.

(30) Foreign Application Priority Data

Feb. 7, 2001 (AU) ..... PR2941

(51) Int. Cl.
*A63F 9/00* (2006.01)

(52) U.S. Cl.
USPC ..... 463/20

(58) Field of Classification Search
USPC ..... 463/1, 2, 10, 16–22, 25–34, 37, 38, 46, 463/47; 273/273, 274, 138.1, 139; 345/418, 345/581, 592, 646, 672–683, 706, 950, 952
See application file for complete search history.

(56) References Cited

U.S. PATENT DOCUMENTS

| | | | |
|---|---|---|---|
| 1,681,683 | A | 8/1928 | Ramer |
| 3,580,581 | A | 5/1971 | Raven |
| 4,306,768 | A | 12/1981 | Egging |
| 4,448,419 | A | 5/1984 | Telnaes |
| 4,686,521 | A | 8/1987 | Beaven et al. |
| 4,711,451 | A | 12/1987 | Pajak et al. |
| 4,718,672 | A | 1/1988 | Okada |
| 4,743,024 | A | 5/1988 | Helm et al. |
| 4,756,531 | A | 7/1988 | DiRe et al. |
| 4,826,169 | A | 5/1989 | Bessho et al. |
| 4,838,552 | A | 6/1989 | Hagiwara |
| 4,856,787 | A | 8/1989 | Itkis |

(Continued)

FOREIGN PATENT DOCUMENTS

| | | |
|---|---|---|
| AU | 1988/17509 | 12/1988 |
| AU | 1994/70382 | 8/1995 |

(Continued)

OTHER PUBLICATIONS

Communication to Australian Commissioner of Patents of Sep. 15, 2004 re Application 200210214 (PR2941).

(Continued)

*Primary Examiner* — Seng H Lim
(74) *Attorney, Agent, or Firm* — McAndrews, Held & Malloy, Ltd.

(57) ABSTRACT

A method of enhancing a screen display of a gaming machine includes creating a background scene for a game screen, creating a plurality of composite symbols to overlie the background scene, and rendering at least a portion of each composite symbol transparent to enable the background scene to be viewed through the composite symbol.

6 Claims, 7 Drawing Sheets

(56) References Cited

U.S. PATENT DOCUMENTS 4,871,171 A 10/1989 Rivero
5,042,818 A 8/1991 Weingardt
5,088,737 A 2/1992 Frank et al.
5,150,907 A 9/1992 Desmarais et al.
5,152,529 A 10/1992 Okada
5,228,693 A 7/1993 Howard
5,283,560 A 2/1994 Bartlett
5,344,145 A 9/1994 Chadwick et al.
5,351,966 A 10/1994 Tohyama et al.
5,354,069 A 10/1994 Guttman et al.
5,375,830 A 12/1994 Takemoto et al.
5,380,007 A 1/1995 Travis et al.
5,395,111 A 3/1995 Inoue
5,462,277 A 10/1995 Takemoto
5,580,053 A 12/1996 Crouch
5,596,693 A 1/1997 Needle et al.
5,630,753 A 5/1997 Fuchs
5,655,965 A * 8/1997 Takemoto et al. ..... 463/20
5,664,999 A 9/1997 Kurihara
5,673,401 A 9/1997 Volk et al.
5,704,835 A 1/1998 Dietz, II
5,732,950 A 3/1998 Moody
5,752,881 A 5/1998 Inoue
5,766,074 A * 6/1998 Cannon et al. ..... 463/16
5,803,809 A 9/1998 Yoseloff
5,807,172 A 9/1998 Piechowiak
5,807,178 A 9/1998 Todokoro
5,816,915 A 10/1998 Kadlic
5,816,916 A 10/1998 Moody
5,823,873 A 10/1998 Moody
5,836,586 A 11/1998 Marks et al.
5,848,932 A 12/1998 Adams
5,853,325 A 12/1998 Kadlic
5,867,166 A 2/1999 Myhrvold
5,868,619 A 2/1999 Wood et al.
5,870,097 A 2/1999 Snyder et al.
5,880,709 A 3/1999 Itai et al.
5,890,962 A 4/1999 Takemoto
5,902,184 A 5/1999 Bennett
5,935,002 A 8/1999 Falciglia
5,951,397 A 9/1999 Dickinson
5,956,180 A 9/1999 Bass et al.
5,971,849 A 10/1999 Falciglia
5,980,384 A 11/1999 Barrie
6,004,208 A * 12/1999 Takemoto et al. ..... 463/20
6,007,066 A 12/1999 Moody
6,050,568 A 4/2000 Hachquet
6,059,289 A 5/2000 Vancura
6,062,978 A 5/2000 Martino et al.
6,086,066 A 7/2000 Takeuchi
6,089,977 A 7/2000 Bennett
6,089,978 A 7/2000 Adams
6,098,985 A 8/2000 Moody
6,105,962 A 8/2000 Malavazos
6,106,393 A 8/2000 Sunaga et al.
6,113,102 A 9/2000 Marks et al.
6,118,427 A 9/2000 Buxton
6,120,031 A 9/2000 Adams
6,120,378 A 9/2000 Moody et al.
6,123,333 A 9/2000 McGinnis, Sr. et al.
6,126,542 A 10/2000 Fier
6,135,883 A 10/2000 Hachquet
6,135,884 A 10/2000 Hedrick et al.
6,142,874 A * 11/2000 Kodachi et al. ..... 463/20
6,142,875 A * 11/2000 Kodachi et al. ..... 463/20
6,149,156 A 11/2000 Feola
6,159,095 A 12/2000 Frohm et al.
6,159,097 A 12/2000 Gura
6,159,098 A 12/2000 Slomiany et al.
6,162,121 A 12/2000 Morro et al.
6,164,645 A 12/2000 Weiss
6,173,955 B1 1/2001 Perrie et al.
6,190,254 B1 2/2001 Bennett
6,203,429 B1 3/2001 Demar et al.
6,211,881 B1 * 4/2001 Gabler et al. ..... 345/418
6,213,875 B1 4/2001 Suzuki
6,220,959 B1 * 4/2001 Holmes et al. ..... 463/13
6,234,897 B1 * 5/2001 Frohm et al. ..... 463/20
6,251,013 B1 6/2001 Bennett
6,254,481 B1 7/2001 Jaffe
6,261,177 B1 7/2001 Bennett
6,270,405 B1 8/2001 Ferguson
6,270,411 B1 * 8/2001 Gura et al. ..... 463/20
6,290,600 B1 * 9/2001 Glasson ..... 463/20
6,311,976 B1 11/2001 Yoseloff et al.
6,312,334 B1 11/2001 Yoseloff
6,315,660 B1 11/2001 DeMar et al.
6,317,128 B1 11/2001 Harrison et al.
6,319,124 B1 * 11/2001 Baerlocher et al. ..... 463/20
6,322,309 B1 11/2001 Thomas et al.
6,334,613 B1 1/2002 Yoseloff
6,346,043 B1 2/2002 Colin et al.
6,347,996 B1 * 2/2002 Gilmore et al. ..... 463/17
6,354,939 B1 3/2002 Morita et al.
6,364,766 B1 4/2002 Anderson et al.
6,368,216 B1 4/2002 Hedrick et al.
6,375,570 B1 * 4/2002 Poole ..... 463/31
6,380,956 B1 4/2002 Yee et al.
6,398,217 B1 * 6/2002 Shimizu et al. ..... 273/121 B
6,398,220 B1 6/2002 Inoue
6,428,412 B1 8/2002 Anderson et al.
6,435,509 B2 8/2002 Wichinsky et al.
6,443,837 B1 9/2002 Jaffe et al.
6,454,266 B1 9/2002 Breeding et al.
6,474,645 B2 11/2002 Tarantino
6,482,089 B2 11/2002 DeMar et al.
6,505,117 B1 1/2003 Ratert et al.
6,506,116 B1 1/2003 Sunaga et al.
6,508,707 B2 1/2003 DeMar et al.
6,517,432 B1 2/2003 Jaffe
6,517,433 B2 * 2/2003 Loose et al. ..... 463/20
6,520,855 B2 2/2003 DeMar et al.
6,529,626 B1 3/2003 Watanabe et al.
6,533,660 B2 3/2003 Seelig et al.
6,554,704 B2 * 4/2003 Nicastro et al. ..... 463/20
6,569,018 B2 5/2003 Jaffe
6,582,305 B1 6/2003 Carter
6,587,118 B1 7/2003 Yoneda
6,598,877 B1 7/2003 Luciano et al.
6,604,740 B1 * 8/2003 Singer et al. ..... 273/292
6,607,437 B2 8/2003 Casey et al.
6,659,867 B1 * 12/2003 Kodachi et al. ..... 463/20
6,672,958 B2 1/2004 Bennett
6,675,387 B1 * 1/2004 Boucher et al. ..... 725/105
6,695,697 B1 * 2/2004 Okada ..... 463/20
6,709,331 B2 * 3/2004 Berman ..... 463/16
6,780,105 B1 * 8/2004 Kaminkow ..... 463/16
6,960,133 B1 * 11/2005 Marks et al. ..... 463/20
7,077,745 B2 * 7/2006 Gomez et al. ..... 463/20
7,115,033 B1 * 10/2006 Timperley ..... 463/20
7,128,647 B2 * 10/2006 Muir ..... 463/20
7,281,980 B2 * 10/2007 Okada et al. ..... 463/20
7,316,609 B2 * 1/2008 Dunn et al. ..... 463/16
7,322,884 B2 * 1/2008 Emori et al. ..... 463/16
7,326,113 B2 * 2/2008 Bennett et al. ..... 463/25
7,329,181 B2 * 2/2008 Hoshino et al. ..... 463/20
7,371,168 B2 * 5/2008 Bilyeu et al. ..... 463/20
7,465,228 B2 * 12/2008 Okada ..... 463/20
7,927,207 B2 * 4/2011 Okada ..... 463/20
2001/0031658 A1 * 10/2001 Ozaki et al. ..... 463/16
2002/0119818 A1 8/2002 Savio et al.
2002/0123378 A1 9/2002 Bucknall et al.
2002/0175466 A1 * 11/2002 Loose et al. ..... 273/143 R
2003/0013519 A1 * 1/2003 Bennett ..... 463/25
2003/0045343 A1 * 3/2003 Luccesi et al. ..... 463/20
2003/0064781 A1 * 4/2003 Muir ..... 463/20
2003/0069063 A1 * 4/2003 Bilyeu et al. ..... 463/20
2003/0092487 A1 * 5/2003 Meyer ..... 463/30
2004/0048646 A1 * 3/2004 Visocnik ..... 463/16
2004/0072613 A1 * 4/2004 Visocnik ..... 463/25
2004/0150162 A1 * 8/2004 Okada ..... 273/292
2004/0209681 A1 * 10/2004 Emori et al. ..... 463/31
2004/0229680 A1 * 11/2004 Hoshino et al. ..... 463/20
2004/0242312 A1 * 12/2004 Gomez et al. ..... 463/20

(56) References Cited

U.S. PATENT DOCUMENTS

| | | | | |
|---|---|---|---|---|
| 2005/0059459 | A1* | 3/2005 | Dunn et al. | 463/16 |
| 2007/0032292 | A1* | 2/2007 | Timperley | 463/20 |
| 2007/0072665 | A1* | 3/2007 | Muir | 463/12 |
| 2007/0226621 | A1* | 9/2007 | Dayan et al. | 715/706 |
| 2009/0305770 | A1* | 12/2009 | Bennett et al. | 463/20 |
| 2010/0304831 | A1* | 12/2010 | Suda et al. | 463/20 |
| 2011/0117987 | A1* | 5/2011 | Aoki et al. | 463/20 |

FOREIGN PATENT DOCUMENTS

| | | | |
|---|---|---|---|
| AU | 708104 | | 10/1997 |
| AU | 1997/45197 | | 1/1998 |
| AU | 1999/42504 | | 12/1999 |
| AU | 1999/43488 | | 3/2000 |
| DE | 29 38 307 | | 4/1981 |
| DE | 44 26 658 | | 1/1996 |
| EP | 0 368 628 | | 5/1990 |
| GB | 1535095 | | 12/1978 |
| GB | 2056737 | | 3/1981 |
| GB | 2072395 | | 9/1981 |
| GB | 2 098 778 | | 11/1982 |
| GB | 2 137 392 | | 10/1984 |
| GB | 2229371 | | 9/1990 |
| GB | 2233241 | | 1/1991 |
| GB | 2252705 | | 8/1992 |
| GB | 2271262 | | 4/1994 |
| JP | 404114676 | A | 4/1992 |
| WO | WO 93/03464 | | 2/1993 |
| WO | WO 96/08799 | | 3/1996 |
| WO | WO 97/31344 | | 8/1997 |
| WO | WO 97/32285 | | 9/1997 |
| WO | 9942889 | B1 | 8/1999 |
| WO | 9964997 | B1 | 12/1999 |
| WO | WO 99/64997 | | 12/1999 |
| WO | WO 00/32286 | | 6/2000 |
| WO | 0115127 | B1 | 3/2001 |
| WO | 0128647 | B1 | 4/2001 |
| WO | WO 01/28647 | | 4/2001 |
| WO | WO 01/89646 | | 11/2001 |
| WO | WO 01/89647 | | 11/2001 |

OTHER PUBLICATIONS

Lara Croft Tomb Raider Web Page, http://shopping.yahoo.com/shop?d=zvgm&id=1951008664&clink=dmks/Tomb_Raider, p. 1.

Fey, Marshall, Slot Machines a Pictorial History of the First 100 Years, 1983-1997, Liberty Belle Books, selected pages supplied in U.S. Appl. 10/001,433.

* cited by examiner

GAMING MACHINE WITH TRANSPARENT SYMBOL CARRIERS

CROSS-REFERENCE TO RELATED APPLICATIONS

This application is a continuation application of U.S. patent application Ser. No. 10/072,401, filed Feb. 6, 2002 entitled GAMING MACHINE WITH TRANSPARENT SYMBOL CARRIERS, which claims priority to Australian application PR 2941, filed Feb. 7, 2001 entitled GAMING MACHINE WITH TRANSPARENT SYMBOL CARRIERS.

FIELD OF THE INVENTION

This invention relates to a gaming machine. More particularly, the invention relates to a method of enhancing a screen display of a gaming machine and to a gaming machine screen display.

BACKGROUND TO THE INVENTION

Players regularly playing gaming machines quickly tire of particular games. It is therefore necessary for manufacturers of these machines to develop innovative game features which add interest to the games. In so doing, it is hoped to keep players amused and therefore willing to continue playing the game as well as to attract new players. Also, with the growth that has occurred in the gaming machine market, there is intense competition between manufacturers to supply various existing and new venues. When selecting a supplier of gaming machines, the operator of a venue will often pay close attention to the popularity of various games and their displays with the patrons of the venue. Therefore, gaming machine manufacturers are keen to devise games and/or gaming machine features which are popular with the players and which are also distinguishable from gaming machines of other manufacturers as a mechanism for improving sales, retaining customers and attracting new customers.

These days, particularly with spinning reel type games, the reels and the symbols carried on the reels used by the various manufacturers can be very similar to each other and it may be hard for a player or an operator of a venue to determine, at a glance, which manufacturer has manufactured a particular machine.

The invention will be described with reference to a spinning reel-type game and, more particularly, a video simulation of spinning reels. It will, however, be appreciated that the invention is equally applicable to other types of games played on gaming machines such as card games, bingo game, keno games, or the like.

In a video simulation of a spinning reel, a background of a symbol is opaque to give the appearance of a periphery of a reel. In a typical screen display, three reel positions are visible for each reel. Accordingly, symbols are arranged end-to-end to provide an appearance of an opaque periphery of a reel.

Technically, in the terminology of gaming machines, a symbol incorporates a background portion plus an indicium carried on the background portion. It is the background portion of the symbol that is opaque to provide the appearance of a part of the periphery of the reel.

However, for ease of explanation in this specification, the term "composite symbol" shall be used with a background portion of the composite symbol being referred to as a "carrier" and the indicium arranged on the background portion being referred to as a "symbol".

SUMMARY OF THE INVENTION

According to a first aspect of the invention, there is provided a method of enhancing a screen display of a gaming machine, the method including the steps of:

creating a background scene for a game screen;

creating a plurality of composite symbols to overlie the background scene; and rendering at least a portion of each composite symbol transparent to enable the background scene to be viewed through the composite symbol.

As indicated above, the invention shall be described, for ease of reference, with reference to a spinning reel type game in which the screen display embodies a video simulation of a number of spinning reels. In most gaming machines, the screen display comprises from three to five spinning reels. Further, as indicated above, at least three positions are visible in respect of each reel on the screen display so that a matrix of composite symbol positions is displayed on the screen. In a typical example, the screen display comprises a matrix of 3×5 composite symbol positions.

Typically, the method may include rendering a carrier of each of at least certain of the composite symbols transparent so that, with a matrix of composite symbols displayed on the screen display, an appearance is created that a periphery of each of the reels is transparent. In so doing, the background scene, applied to the game screen is visible through said transparent carriers of each of the composite symbols.

The method may include rendering the portion of each composite symbol transparent by an appropriate software implementation. In particular, the method may include setting the portion of each composite symbol to an appropriate alpha channel value in an alpha channel range.

Accordingly, the method may include employing an objects based graphics system for development of the composite symbol with portions of the composite symbol being rendered opaque.

Further, it will be appreciated that, in use, when a composite symbol forms part of a prize winning combination it flashes.

Hence, the method may include creating a representation of a flashing composite symbol.

The method may include placing a part of the background scene over the composite symbol and placing a flashing composite symbol animation on top of the part of the background scene to provide a flashing composite symbol. Instead, the method may cause the actual composite symbol itself to be flashed on and off directly on top of the underlying part of the background scene so that the background scene remains visible and any background animations, if applicable, continue while the composite symbol flashes.

According to a second aspect of the invention, there is provided a gaming machine screen display which includes:

a background scene for a game screen; and a plurality of composite symbols which overlie the background scene, at least a portion of each composite symbol being transparent to enable the background scene to be viewed through the composite symbol.

A carrier of each of at least certain of the composite symbols may be rendered transparent. The portion of each composite symbol may be rendered transparent by an appropriate selection of alpha channel value in an alpha channel range.

The screen display may comprise a composite image with the composite symbols overlying the background scene.

The screen display may incorporate various animations, either in the background scene, in the composite symbols themselves or in a foreground part of the screen display where the animations interact with particular composite symbols of the screen display.

BRIEF DESCRIPTION OF THE DRAWINGS

The invention is now described by way of example with reference to the accompanying diagrammatic drawings.

In the drawings.

DETAILED DESCRIPTION OF THE DRAWINGS

Figure 1:
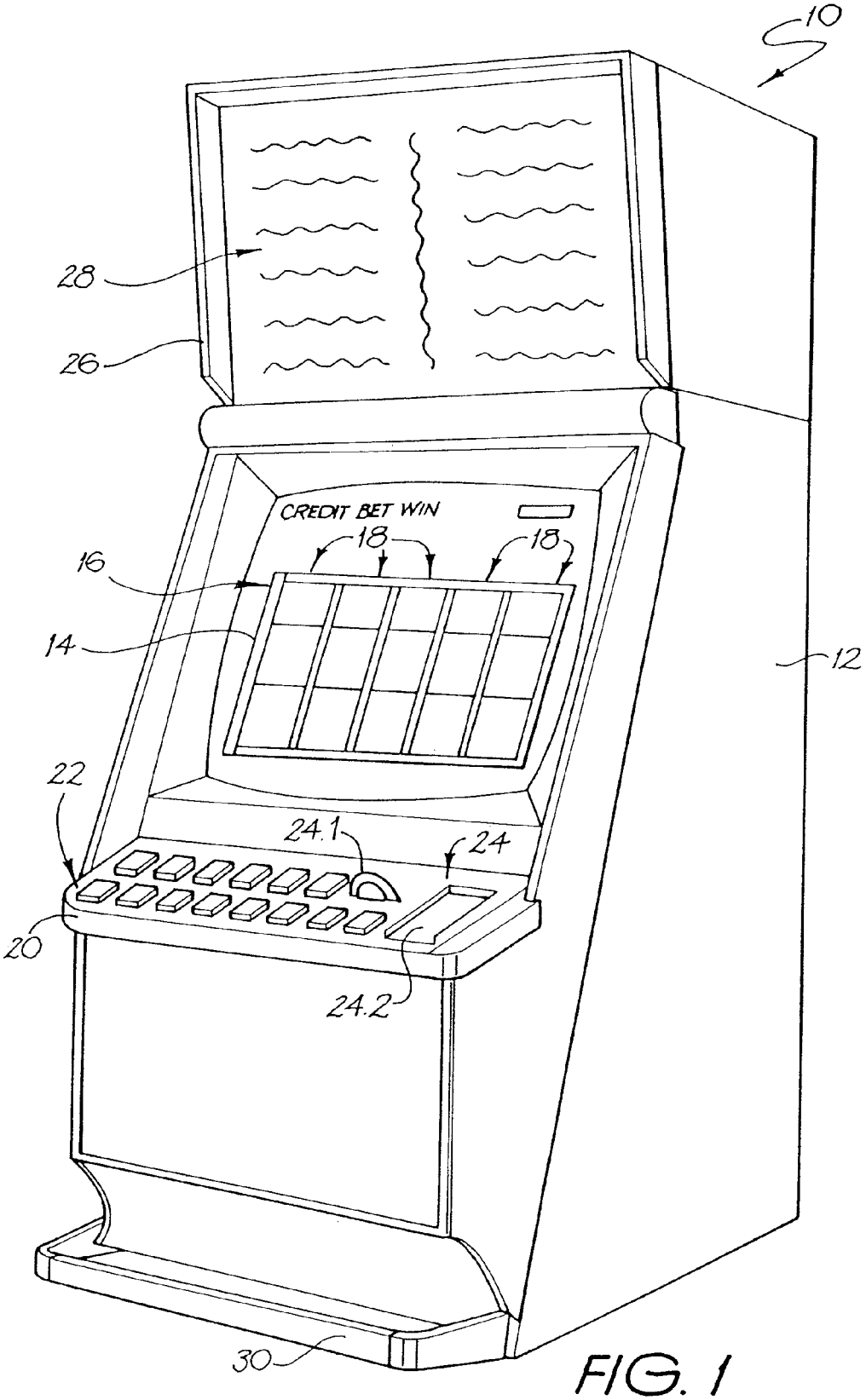
FIG. 1 shows a three dimensional view of a gaming machine, including a screen display in accordance with the invention.

In FIG. 1, reference numeral 10 generally designates a gaming machine, including a game, in accordance with the invention. The machine 10 includes a console 12 having a video display unit 14 on which a game 16 is played, in use. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
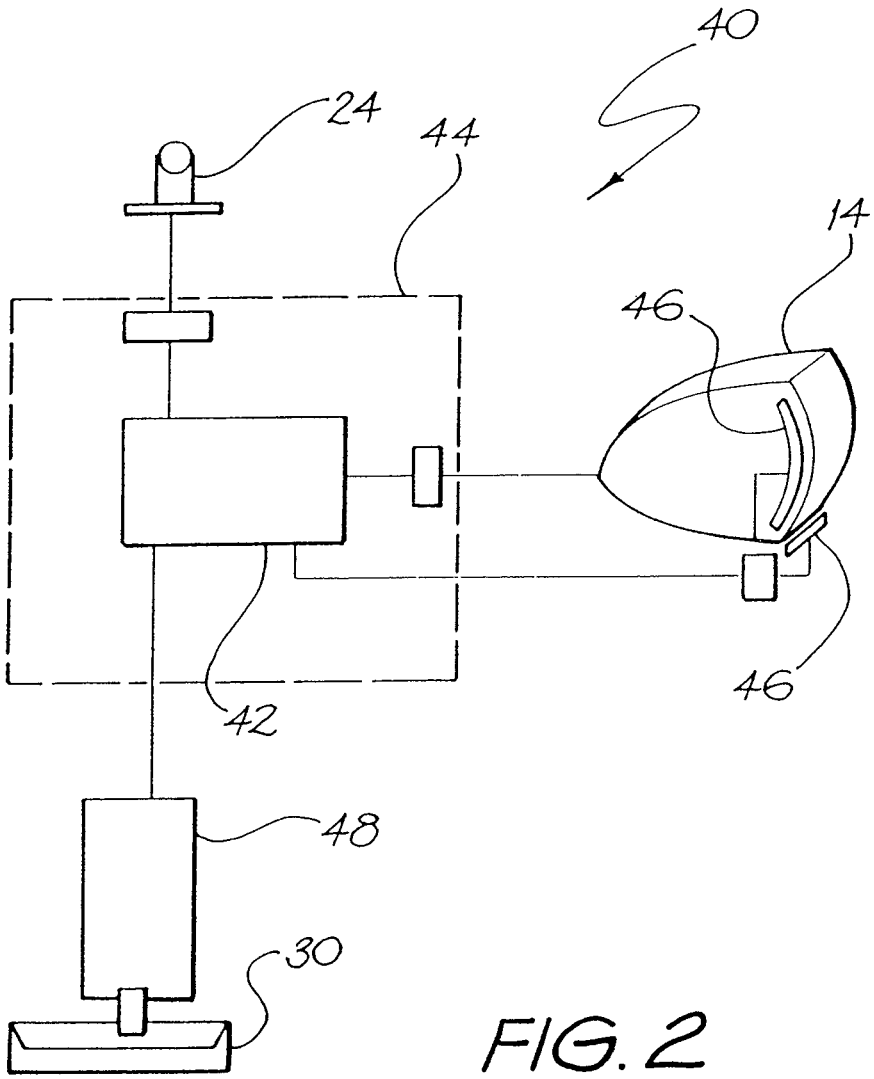
FIG. 2 shows a block diagram of a control circuit of the gaming machine.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen. The controller 44 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to make a pay out to a player when the player wishes to redeem his or her credits To develop a screen display for the gaming machine 10 an objects based graphics system is used. The objects based graphics system makes use of an audiovisual library or media file. Each game 16 played on the gaming machine 10 has its own audio visual library file from which a developer of a program to implement the game obtains characters for use on composite symbols which are dedicated to that particular game.

Figure 3:
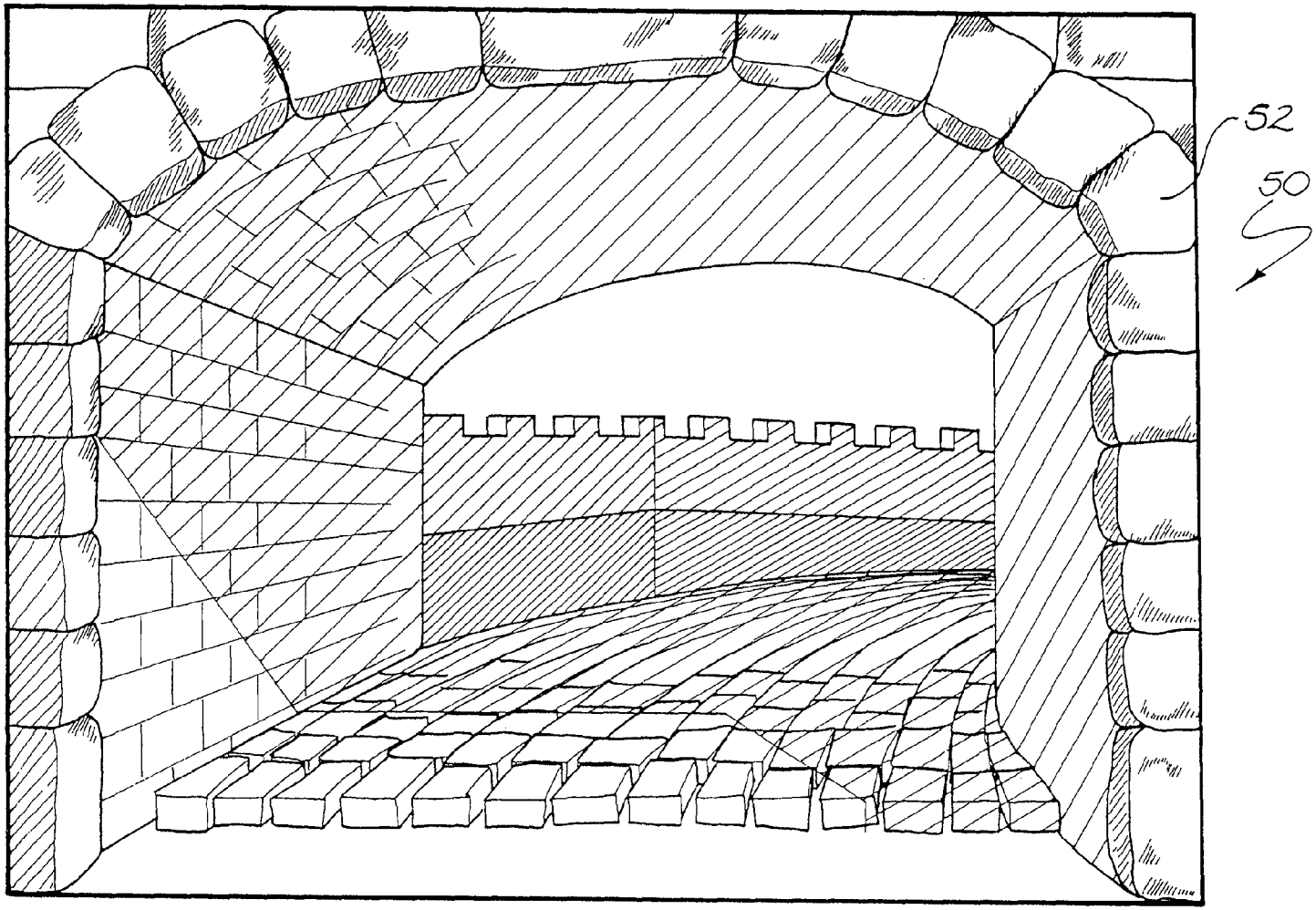
FIG. 3 shows a background part of a screen display forming part of the gaming machine of FIG. 1.

In order to enhance the appearance of a screen display 50 (FIGS. 3 to 5) of a game 16 played on the gaming machine 10, a background scene or image 52 is created. For example, for the applicant's Flaming Arrow™ game (Flaming Arrow is a trade mark of the Applicant), the background scene 52 is part of a castle.

Figure 6:
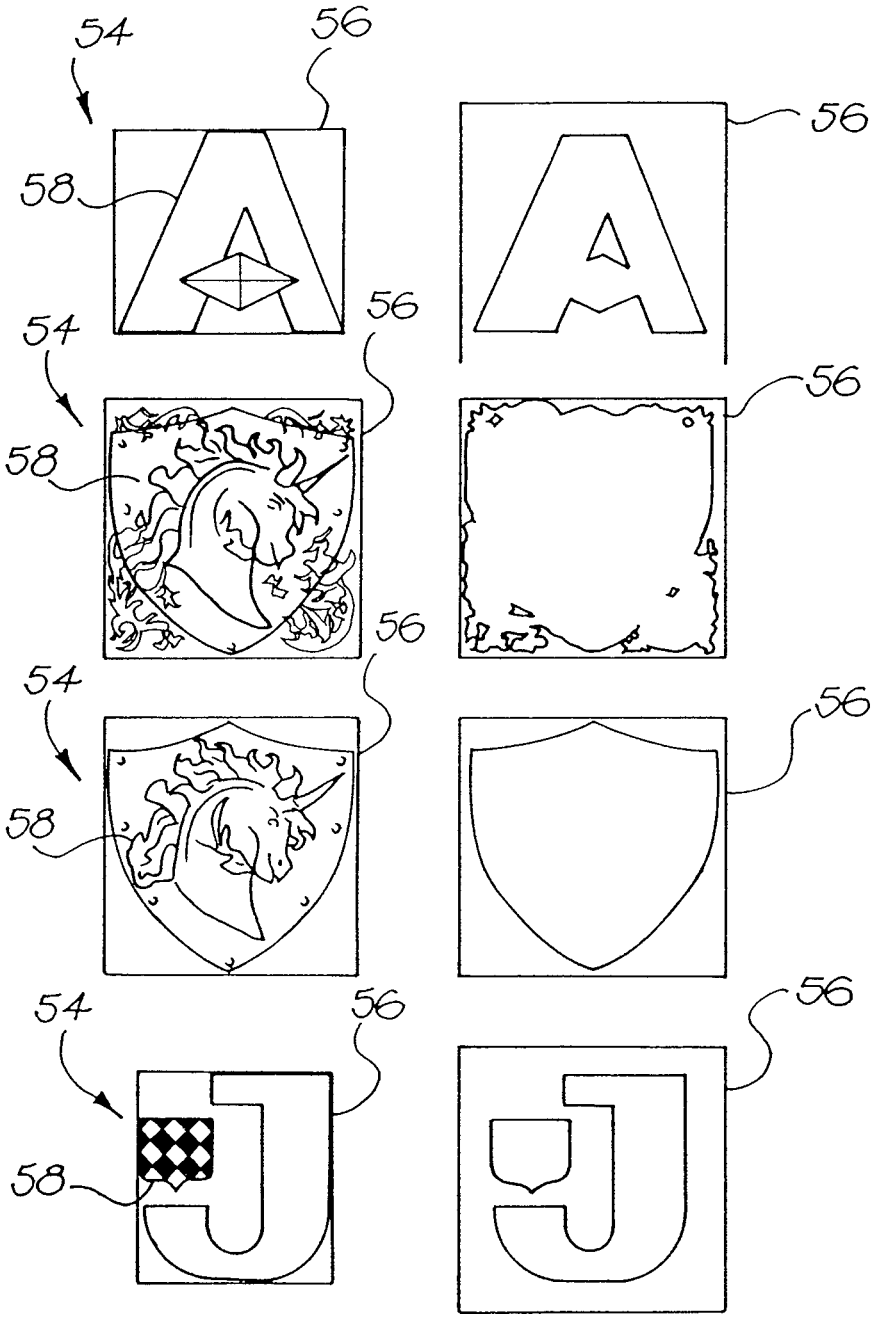
FIG. 6 shows a selection of composite symbols forming part of the screen display, in use, together with their associated transparent carriers.
Figure 7:
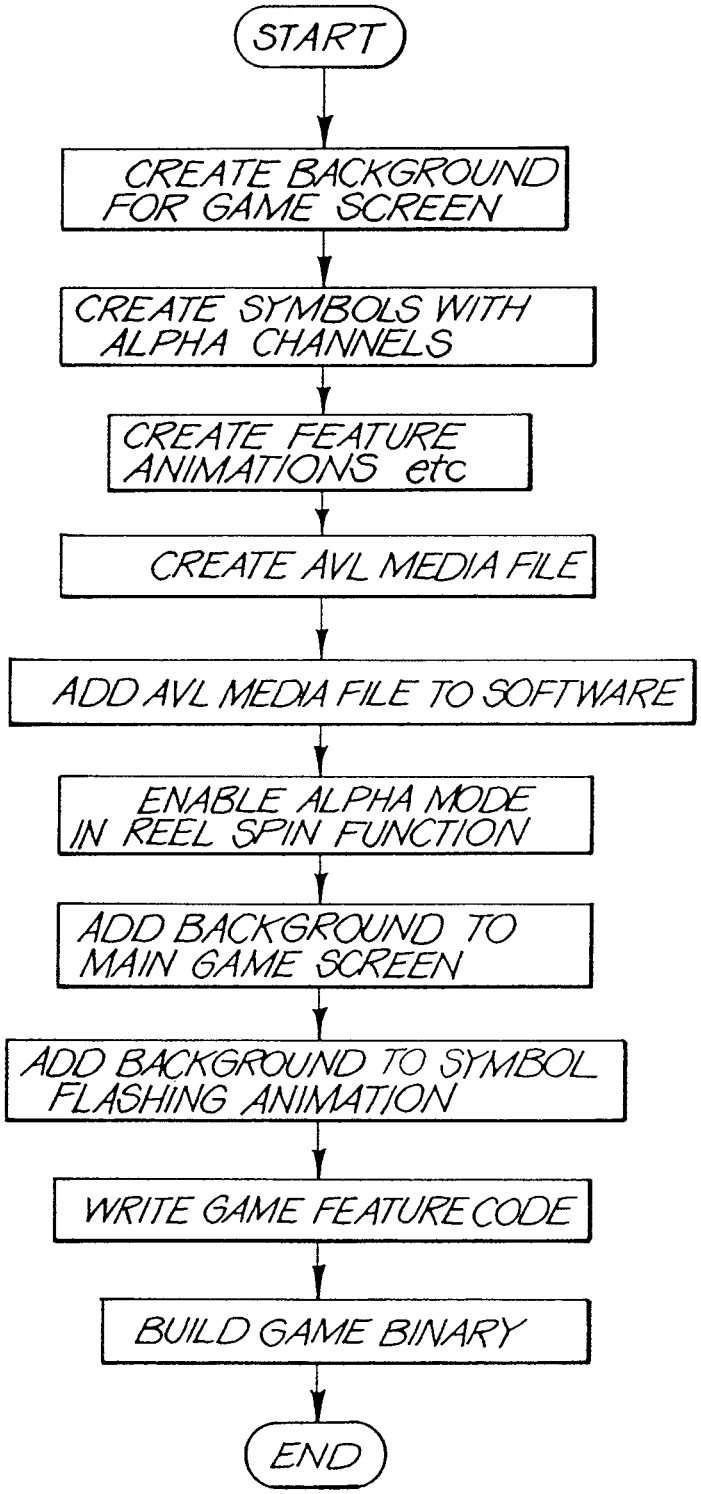
FIG. 7 shows a flow chart of a manner of implementing the screen display.

Composite symbols for use with the particular game are then created. A selection of the symbols for use in the Flaming Arrow™ game is shown in FIG. 6 of the drawings. Each composite symbol 54 includes a carrier 56 and a symbol 58.

For each composite symbol 54, the carrier 56 is selected to have an alpha channel value which renders it at least partly transparent. Alpha channel values generally lie in a range between 0 and 255. For a completely transparent carrier 56, an alpha channel value of 255 is selected. If it is desired that the carrier 56 have a degree of translucence a lower alpha channel value can be selected.

It will be appreciated that, in FIG. 6 of the drawings, although the carrier 56 of each composite symbol 54 is shown as black, it is, as described above, transparent.

Once the composite symbols 54 have been generated with their appropriate alpha channel values for the carriers 56, various feature animations etc. are created in accordance with standard game development procedure.

The feature animations, composite symbols 54 with their appropriate alpha channel values and background scene 52 are merged into an audiovisual library (AVL) media file.

The AVL media file is then added to the software developed for the particular game.

In this software, an alpha mode is enabled so that the alpha channel value of the composite symbols 54 is taken into consideration by the AVL when displaying the composite symbols 54.

If the alpha channel value of each composite symbol 54 indicates that the symbol has a transparency component, that part of each composite symbol 54 will be transparent.

It will be appreciated that, for a spinning reel game, the composite symbols 54 are arranged end-to-end to form the reels 18 of the game 16. With the transparent carrier 56 of each composite symbol 54, an appearance of a reel 18 with a transparent periphery is created so that the underlying background scene 52 is visible through the transparent carriers 56 of the composite symbols 54.

Once the alpha mode has been enabled, the background scene 52 is added to the main game screen by appropriate programming.

Reel symbol animation is then carried out. Reel symbol animation is applicable when a particular composite symbol 54 of one of the reels 18 forms part of a winning combination. Normally, when a symbol of a spinning reel game forms part of a winning combination, that symbol flashes.

Figure 4:
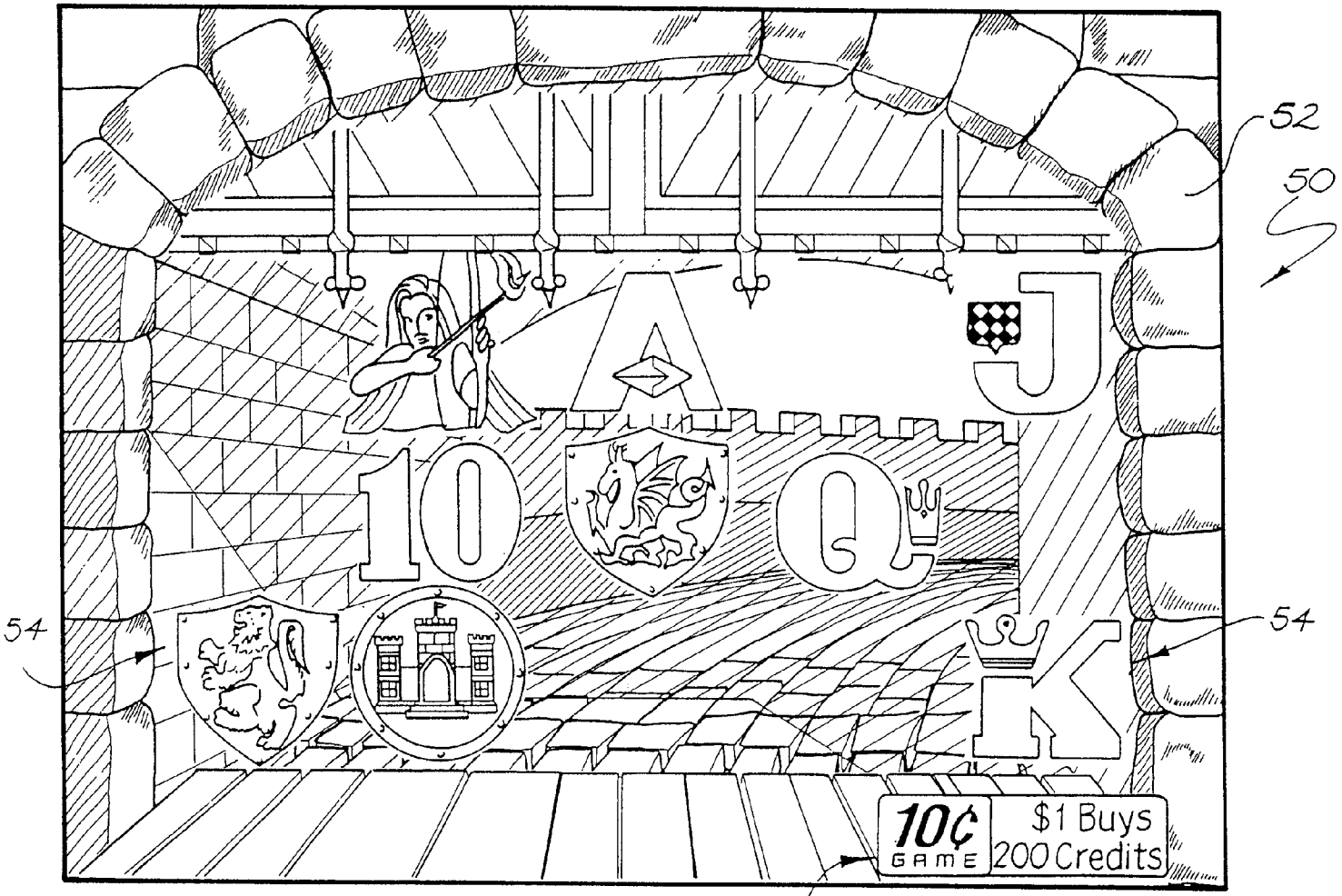
FIG. 4 shows a screen display including some composite symbols.

In most cases the reel symbol animation can simply involve the relevant composite symbols 54 flashing on and off. Each composite symbol 54 forming part of the winning combination could also animate, for example, with a moving image or could simply fade on and off bearing in mind that a background 52 is now in place. Instead, a part of the background scene could be applied to overlie the relevant composite symbol 54 with the flashing symbol animation then being placed over the top of the overlying part of the background scene to flash to represent the winning composite symbols 54. Instead, the actual composite symbol 54 may simply flash as described above. An example of this is shown in FIG. 4 of the drawings where some of the composite symbols are shown in an "off" condition so as to be, effectively, invisible with the background scene 52 then being visible where the composite symbols 54 are in their "off" conditions.

Figure 5:
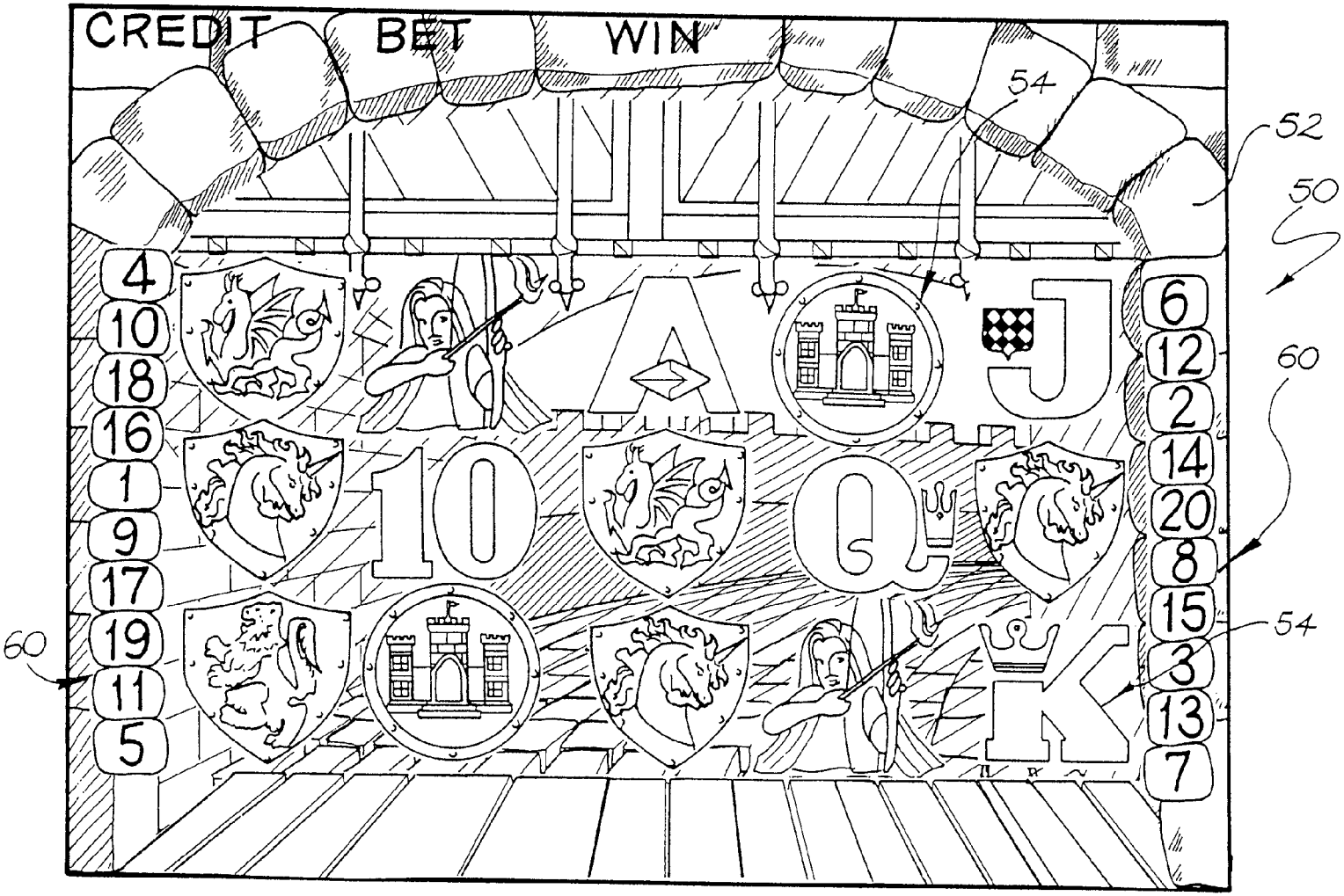
FIG. 5 shows a screen display including all the composite symbol visible at any one time.

Payline indicators 60 are shown in FIG. 5 of the drawings.

The game feature code and a game binary are implemented using standard game programming procedures.

The game feature code can include animations associated with the composite symbols 54. Once again, using the applicant's Flaming Arrow™ game as an example, an archer shoots flaming arrows at the composite symbols 54 causing them to ignite and various bonuses or features may be awarded in respect of such "burning" composite symbols 54. The operation of the Flaming Arrow™ game is discussed in greater detail in the applicant's international patent application number PCT/AU00/01233 which is incorporated herein by reference.

In addition, other animations may occur either behind the composite symbols 54 in the background scene 52 or in the foreground of the composite symbols 54.

It will be appreciated that the manner in which the images are composited depends on the priorities assigned to those images. Thus, the background scene 52 has a lower priority than the composite symbols 54 so is, effectively, at a greater "depth" than the composite symbols 54. Similarly, a label 62 (FIG. 4) designating the denomination of the game has a higher priority than the composite symbol 54 so that it is in the foreground and is always visible.

It is an advantage of the invention that a game screen display 50 is provided which greatly enhances the appearance of the game 16 played on the gaming machine 10. Not only does this provide a more attractive appearance to the game screen display 50 but also enables an operator or a player to determine whose gaming machine 10 is being played by players at a particular venue.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A method of providing a screen display for a video display unit of a gaming apparatus via a gaming controller, wherein an image is displayed in a background on the screen display, the method comprising:

creating via the gaming controller a background scene having at least one animation in the background scene;

creating via the gaming controller a plurality of composite symbols, the composite symbols defining active components of a spinning reel game in which the composite symbols are spun up on a plurality of spinning reels to provide for various combinations of the composite symbols, at least one of the combinations being a winning combination, and each composite symbol having a carrier portion, and a game symbol portion;

displaying on the video display unit the background scene and the plurality of composite symbols so that the plurality of composite symbols overlie the background scene and said at least one animation occurs behind the plurality of composite symbols, and rendering the carrier portion of each of the composite symbols transparent so that at least a portion of the background scene can be viewed through the carrier portions of the symbols;

determining via the gaming controller a winning combination from the displayed selected symbols; and wherein displaying the plurality of composite symbols comprises arranging via the gaming controller groups of the composite symbols end-to-end and representing each group as moving so as to represent movement of the plurality of spinning reels and then stopping to display at least one said combination of composite symbols, and wherein at least a portion of the background scene can be viewed through the carrier portion of the displayed composite symbols, both when the composite symbols are represented as moving and when the composite symbols are represented as stopped, and wherein in response to determining via the gaming controller that the stopped at least one said combination of composite symbols forms a winning combination, animating the composite symbols which forms the winning combination such that the respective composite symbols which forms the winning combination are temporarily rendered transparent such that the background scene underlying the respective composite symbols is visible therethrough before returning the respective composite symbols to an opaque state, and wherein in response to the respective composite symbols being temporarily rendered transparent, revealing said background scene and said at least one animation behind the temporarily transparent symbols, and awarding via the gaming controller one or more bonus prizes in respect of such revealed background scene and said at least one animation.

2. The method of claim 1, wherein said rendering the carrier portions transparent comprises setting said carrier portions to an appropriate alpha channel value in an alpha channel range.

3. The method of claim 2, wherein said setting said carrier portion includes setting said carrier portion to an alpha channel setting which results in completely transparent carrier portions.

4. A method of providing a screen display for a video display unit of a gaming apparatus via a gaming controller, the method comprising:

creating via the gaming controller (1) a background scene defining a passive component of a game and (2) at least one animation in the background scene;

creating via the gaming controller a plurality of symbols, the symbols defining active components of the game, wherein play of the game involves selecting a plurality of the symbols to provide for various combinations of symbols, at least one of the combinations being a winning combination that results in the awarding of an award, wherein each symbol has a carrier portion, and a game symbol portion; and displaying on the video display unit the background scene and displaying the selected plurality of symbols in a pattern overlying the background scene and said at least one animation occurring behind the selected plurality of symbols, the carrier portion of each of the symbols being substantially transparent so that at least a portion of the background scene can be viewed through the carrier portions of the symbols while the symbol portion is initially rendered opaque;

determining via the gaming controller a winning combination from the displayed selected symbols; and wherein in response to determining via the gaming controller a winning combination, animating the selected symbols of the winning combination such that the respective selected symbols of the winning combination are temporarily rendered transparent such that the background scene underlying the respective selected symbols is visible therethrough before returning the respective selected symbols to an opaque state, and wherein in response to the respective selected symbols being temporarily rendered transparent, revealing said background scene and said at least one animation behind the temporarily transparent symbols, and awarding one or more bonus prizes in respect of such revealed background scene and said at least one animation.

5. The method of claim 4, wherein said displaying the selected plurality of symbols in a pattern includes arranging the symbols end-to-end so that the carrier portion of at least certain symbols define in combination a transparent reel strip.

6. The method of claim 5, comprising rendering said carrier portions of said at least certain symbols entirely transparent and providing the screen display so that the only visible portion of the reel strips are the game symbol portions of the said at least certain symbols.

* * * * *

UNITED STATES PATENT AND TRADEMARK OFFICE

CERTIFICATE OF CORRECTION

PATENT NO. : 8,727,864 B2
APPLICATION NO. : 11/623399
DATED : May 20, 2014
INVENTOR(S) : Bucknall et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 574 days.

Signed and Sealed this
Eighth Day of September, 2015

Michelle K. Lee

Michelle K. Lee
*Director of the United States Patent and Trademark Office*